US006779209B2

(12) United States Patent
Ganance

(10) Patent No.: US 6,779,209 B2
(45) Date of Patent: Aug. 24, 2004

(54) BED SIDERAIL APPARATUS

(75) Inventor: Francis C. Ganance, Batesville, IN (US)

(73) Assignee: Hill-Rom Services, Inc., Wilmington, DE (US)

( * ) Notice: Subject to any disclaimer, the term of this patent is extended or adjusted under 35 U.S.C. 154(b) by 146 days.

(21) Appl. No.: 10/079,126

(22) Filed: Feb. 19, 2002

(65) Prior Publication Data

US 2002/0144348 A1 Oct. 10, 2002

Related U.S. Application Data

(63) Continuation-in-part of application No. 09/750,741, filed on Dec. 29, 2000, now Pat. No. 6,658,680.

(51) Int. Cl.[7] ..... A47C 21/08
(52) U.S. Cl. ..... 5/430; 5/425
(58) Field of Search ..... 5/424, 425, 428, 5/430

(56) References Cited

U.S. PATENT DOCUMENTS

| | | | | | |
|---|---|---|---|---|---|
| 2,587,291 | A | | 2/1952 | Des Rochers | 5/430 |
| 3,104,402 | A | | 9/1963 | Johnson | 5/428 |
| 3,197,852 | A | * | 8/1965 | Johnson | 29/446 |
| 3,234,570 | A | * | 2/1966 | Hutt | 5/430 |
| 3,526,008 | A | * | 9/1970 | Pruim | 5/430 |
| 4,484,367 | A | | 11/1984 | Jenkins | 5/425 |
| 4,612,679 | A | | 9/1986 | Mitchell | 5/425 |
| 4,680,790 | A | | 7/1987 | Packard et al. | 379/432 |
| 4,985,946 | A | | 1/1991 | Foster et al. | 5/601 |
| 5,097,550 | A | | 3/1992 | Marra, Jr. | 5/424 |
| 5,187,824 | A | * | 2/1993 | Stryker | 5/430 |
| 5,191,663 | A | | 3/1993 | Holder et al. | 5/424 |
| 5,222,132 | A | | 6/1993 | Rioux, Jr. | 379/455 |
| 5,235,258 | A | | 8/1993 | Schuerch | 318/16 |
| 5,255,403 | A | | 10/1993 | Ortiz | 5/503.1 |
| 5,522,100 | A | * | 6/1996 | Schilling et al. | 5/86.1 |
| 5,542,136 | A | | 8/1996 | Tappel | 5/710 |
| 5,715,548 | A | | 2/1998 | Weismiller et al. | 5/624 |
| 5,732,423 | A | | 3/1998 | Weismiller et al. | 5/425 |
| 5,737,781 | A | | 4/1998 | Votel | 5/81.1 HS |
| 5,802,640 | A | | 9/1998 | Ferrand et al. | 5/617 |
| 5,878,452 | A | | 3/1999 | Brooke et al. | 5/428 |
| 6,008,598 | A | | 12/1999 | Luff et al. | 318/16 |
| 6,253,397 | B1 | * | 7/2001 | Bartow et al. | 5/430 |
| 6,360,385 | B1 | * | 3/2002 | Lewandowski | 5/430 |
| 6,363,552 | B1 | * | 4/2002 | Hornbach et al. | 5/425 |
| 6,640,360 | B2 | * | 11/2003 | Hornbach et al. | 5/425 |
| 2002/0002742 | A1 | | 1/2002 | Osborne et al. | 5/600 |
| 2002/0095724 | A1 | * | 7/2002 | Hornbach et al. | 5/425 |
| 2002/0144348 | A1 | * | 10/2002 | Ganance | 5/600 |

FOREIGN PATENT DOCUMENTS

| | | |
|---|---|---|
| EP | 1108410 A2 | 6/2001 |
| WO | WO 00/69386 | 11/2000 |

* cited by examiner

*Primary Examiner*—Robert G. Santos
(74) *Attorney, Agent, or Firm*—Bose McKinney & Evans LLP

(57) ABSTRACT

A patient support is provided having a frame, a mattress, and at least one siderail. The siderail includes a rail member and a coupler configured to permit raising and lower of the rail member between a lowered egress position and a raised blocking position.

44 Claims, 7 Drawing Sheets

BED SIDERAIL APPARATUS

This application is a continuation-in-part of U.S. application Ser. No. 09/750,741, filed Dec. 29, 2000 now U.S. Pat. No. 6,658,680, titled Hospital Bed, the disclosure of which is expressly incorporated by reference herein.

BACKGROUND AND SUMMARY OF THE INVENTION

The present invention relates to patient supports, such as hospital beds. More particularly, the present invention relates to siderails for patient supports.

Hospital bed and other patient supports are known. Typically, such patient supports are used to provide a support surface for patients or other individuals for treatment, recuperation, or rest. Many such patient supports include a frame, a mattress supported on the frame, and siderails configured to block egress of a patient from the mattress.

According to one aspect of the present invention, a patient support is provided that includes a frame, a mattress supported by the frame, and a siderail supported by the frame. The siderail has a rail member and a linkage assembly. The linkage assembly is configured to permit movement of the rail member between a raised position blocking egress of a patient positioned on the mattress and a lowered position. The linkage assembly includes a first stationary cam member and a first rotary cam member positioned to contact the first stationary cam member to move the rail member along a longitudinal axis in a first direction when the rail member is moved to the lowered position. The linkage assembly also includes a second stationary cam member and a second rotary cam member positioned to contact the second stationary cam member to move the rail member along the longitudinal axis in a second direction opposite the first direction when the rail member is moved to the raised position.

According to another aspect of the present invention, a patient support is provided that includes a frame, a mattress supported by the frame, and a siderail supported by the frame. The siderail has a rail member and a coupler. The coupler is configured to permit movement of the rail member between a raised position blocking egress of a patient positioned on the mattress and a lowered position. The coupler includes a cam assembly configured to move the rail member in a first direction during movement of the rail member.

According to another aspect of the present invention, a patient support is provided that includes a frame, a mattress positioned over the frame, and a siderail. The siderail includes a rail member having a longitudinal axis and a linkage assembly configured to permit movement of the rail member between a raised position blocking egress of a patient positioned on the mattress and a lowered position permitting egress. The linkage assembly has a longitudinal axis that deviates from being perpendicular to and parallel with the longitudinal axis of the rail member at all times during movement of the rail member from the raised to lowered position.

According to another aspect of the present invention, a patient support is provided that includes a frame, a mattress supported by the frame, and a siderail. The siderail includes a rail member and a coupler configured to couple the rail member to the frame. The rail member has a longitudinal axis. The coupler is configured to rotate the rail member about an axis of rotation. The axis of rotation deviates from being perpendicular to and parallel with the longitudinal axis of the rail member at all times during movement of the rail member from the raised to lowered position.

According to another aspect of the present invention, a patient support is provided that includes a frame, a mattress supported by the frame, and a siderail. The siderail includes a rail member having a longitudinal axis and a coupler configured to couple the rail member to the frame and permit movement of the rail member between a raised position blocking egress of a patient positioned on the mattress and a lowered position permitting egress. The coupler is configured to move the rail member in a first longitudinal direction during all downward movement of the rail member from the raised position to the lowered position.

According to another aspect of the present invention, a patient support is provided that includes a frame, a mattress positioned over the frame, and a siderail. The siderail includes a rail member having a longitudinal axis and a coupler configured to permit movement of the rail member between a raised position blocking egress of a patient positioned on the mattress and a lowered position permitting egress. The coupler is configured to move the rail member in a first longitudinal direction during lowering of the rail member to the lowered position without moving in a second longitudinal direction opposite the first longitudinal direction.

According to another aspect of the present invention, a patient support is provided that includes a frame, a mattress positioned over the frame, and a siderail. The siderail includes a rail member having a longitudinal axis and a coupler configured to couple the rail member to the frame and to permit movement of the rail member between a raised position blocking egress of a patient positioned on the mattress and a lowered position. The coupler is configured to move the rail member in a longitudinal direction and a sideways direction away from the mattress during movement of the rail member between the raised and lowered positions.

According to another aspect of the present invention, a patient support is provided that includes a frame, a mattress supported by the frame, and a siderail. The siderail includes a rail member and a coupler configured to permit rotation of the rail member about an axis of rotation between a raised position and a lowered position. The axis of rotation deviates from being horizontal when the mattress is in a flat bed position.

According to another aspect of the present invention, a patient support is provided that includes a frame, a mattress supported by the frame, and a siderail. The siderail includes a rail member having a first longitudinal axis and a linkage assembly. The linkage assembly is configured to support the rail member on the frame and to have a second longitudinal axis. The linkage assembly is configured to permit rotation of the rail member about an axis of rotation. The axis of rotation and the second longitudinal axis of the linkage assembly each have a longitudinal component relative to the first longitudinal axis.

Additional features of the present invention will become apparent to those skilled in the art upon consideration of the following detailed description of the preferred embodiment exemplifying the best mode of carrying out the invention as presently perceived.

DETAILED DESCRIPTION OF THE DRAWINGS

Figure 1:
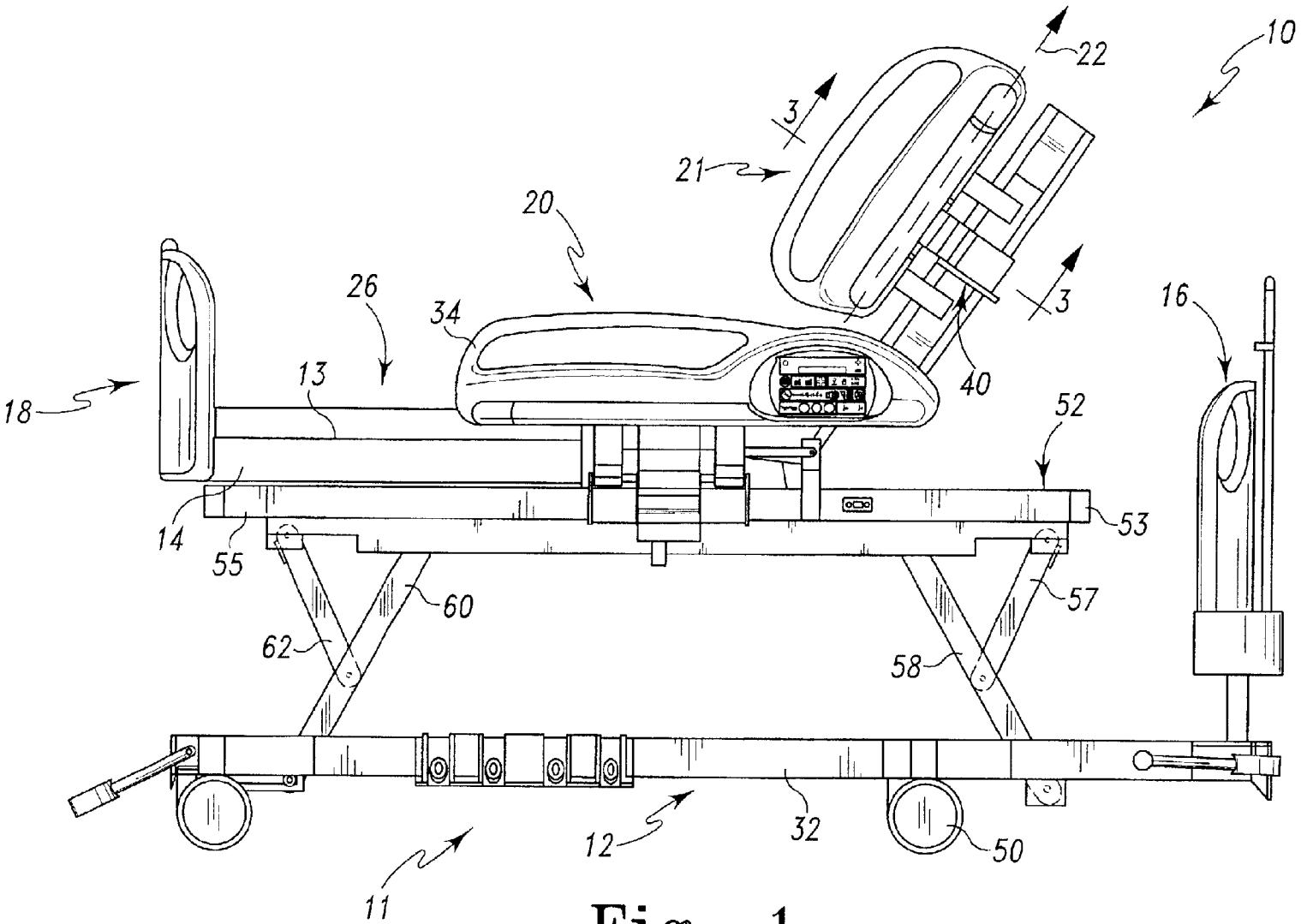
FIG. 1 is side elevation view of a bed showing the bed including a frame having a deck with a head section thereof titled relative to the remainder of the frame and a head end siderail in a raised position.

As shown in FIG. 1, a hospital bed 10 is provided including a frame 11 positioned on the floor and including a sub-frame 12 and a upper frame or deck 14 supported by sub-frame 12, a mattress 13 positioned on deck 14, a headboard 16 coupled to sub-frame 12, a footboard 18 coupled to deck 14, and a pair of split siderails 20, 21 coupled to sub-frame 12. Sub-frame 12 is configured to raise and lower deck 14 relative to the floor and to move deck 14 to the Trendelenburg position and the Reverse Trendelenburg position.

As shown in FIG. 1, sub-frame 12 includes a rectangular lower frame member or base frame 32, a plurality of casters 50 coupled to base frame 32 to permit hospital bed 10 to be rolled about a care facility, a rectangular upper frame member or intermediate frame 52, a linkage system 54 coupled to intermediate and base frames 52, 32 to permit relative motion therebetween, and an actuator system providing power to actuate linkage system 54 and move upper member 52 relative to base frame 32. Linkage system 54 includes a pair of head links 58 pivotably coupled to a head end 53 of intermediate frame 52 and slidably coupled to base frame 32, a pair of guide links 57 pivotably coupled to respective head links 58 and pivotably coupled to intermediate frame 52 at a fixed pivot point, a pair of foot links 60 pivotably coupled to a foot end 55 of intermediate frame 52 and slidably coupled to base frame 32, and a pair of guide links 62 pivotably coupled to respective foot links 60 and pivotably coupled to intermediate frame 52 at a fixed pivot point.

Figure 2:
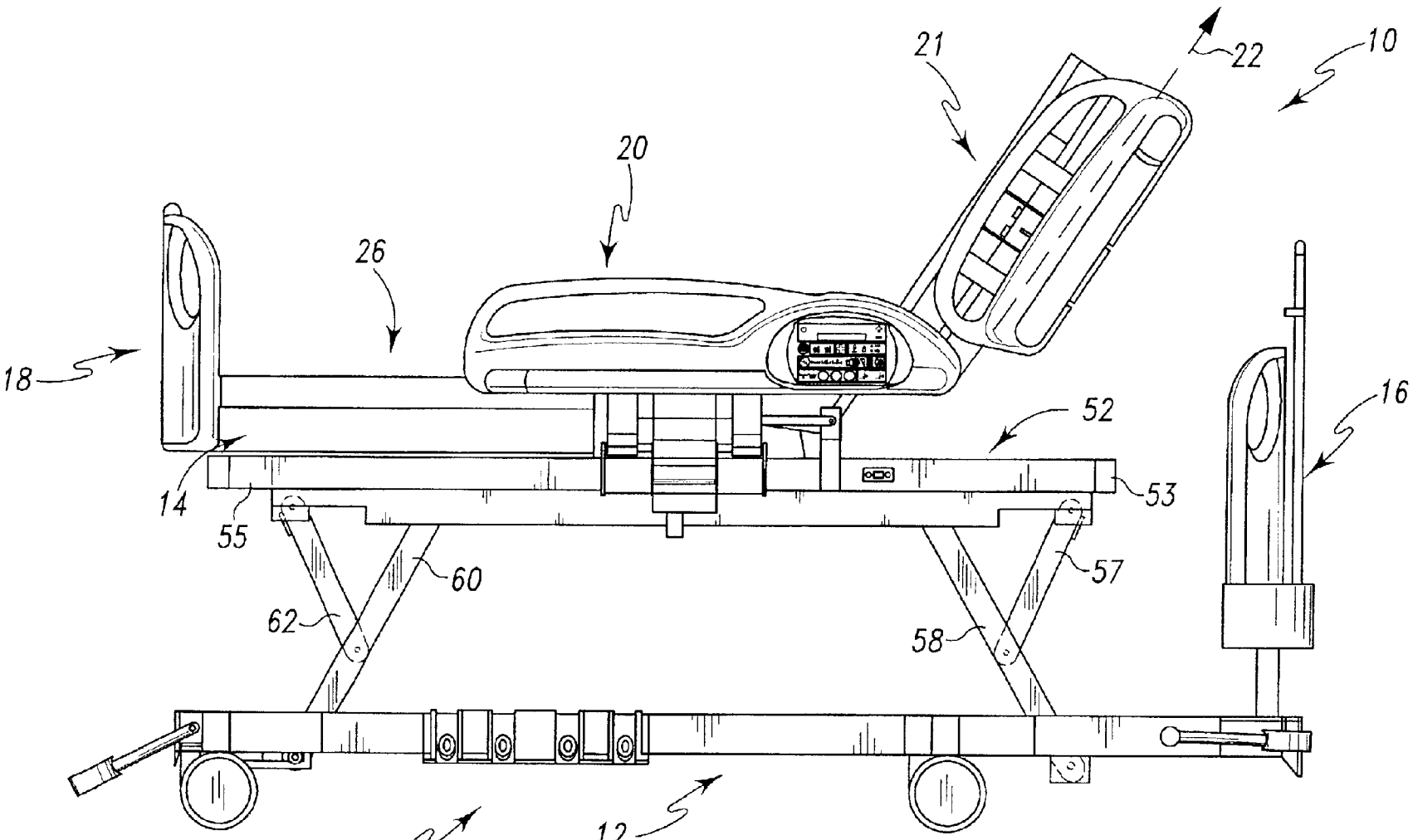
FIG. 2 is a view similar to FIG. 1 showing the head end siderail in a lowered position.

Split siderails 20, 21 are pivotably coupled to respective head section 24 of deck 14 and weigh frame 26. Each siderail 20, 21 is configured to move between raised blocking positions, as shown in FIG. 1, and lowered egress positions, as shown in FIG. 2, to permit entry and egress of patients into and out of hospital bed 10. Each siderail 20, 21 includes a respective rail member 34, 36 and a coupler or linkage assembly 38, 40 coupled between respective rail members 34, 36 and respective head section 24 of deck 14 and weigh frame 26 that permit rail members 34, 36 to be moved between raised and lowered positions.

Linkage assembly 38 includes a first link 42 rigidly coupled to respective head section 24 of deck 14 and weigh frame 26, a pair of curved second links 44 pivotably coupled to first link 42, a third link 46 pivotably coupled to second links 44, and a curved fourth link 48 pivotably coupled to third and first links 42, 46. According to alternative embodiments of the present disclosure, other couplers are provided such as "clocking" siderail linkage assemblies and other couplers known to those of ordinary skill in the art for coupling a rail member to a bed frame.

Figure 3:
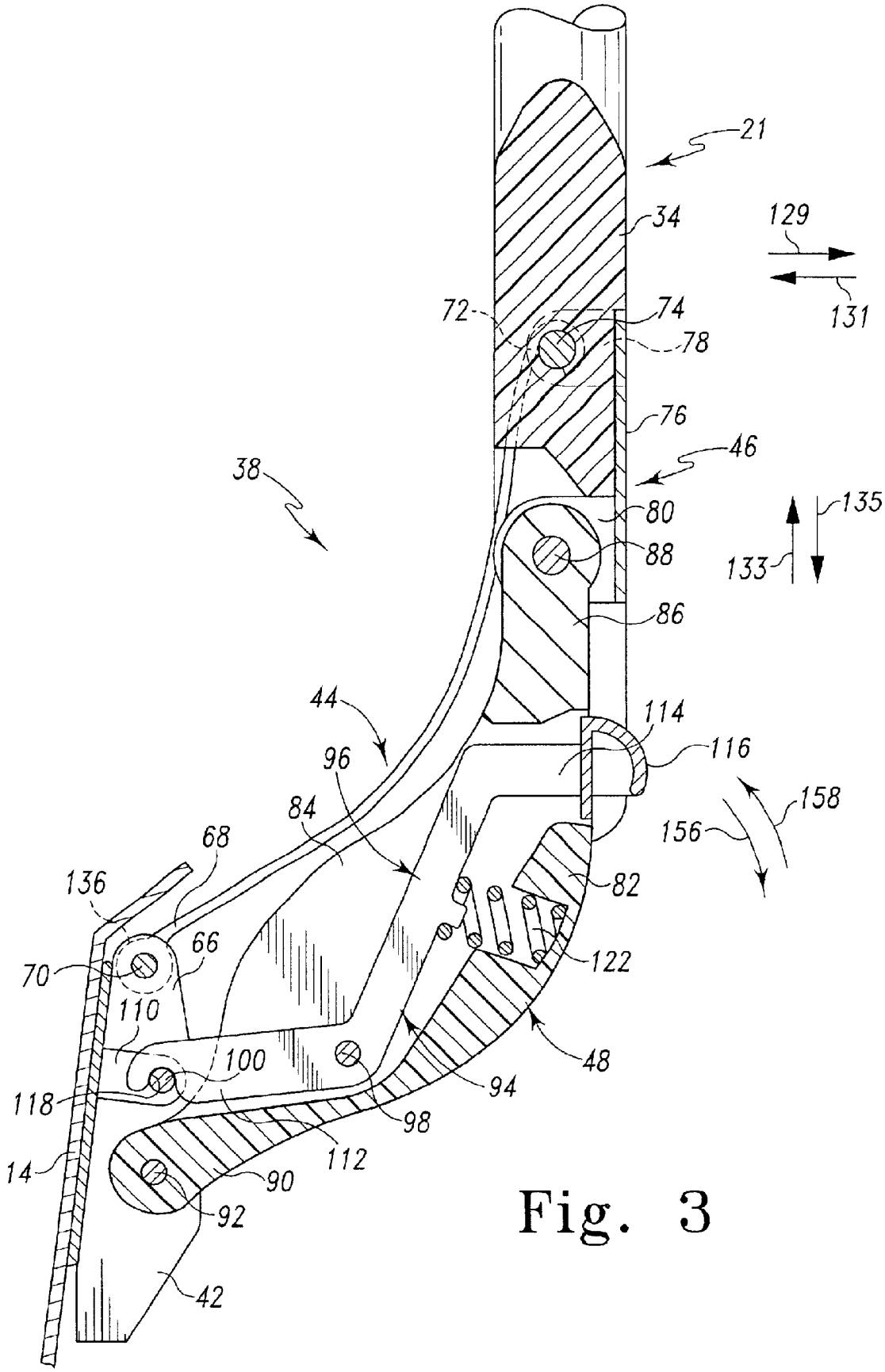
FIG. 3 is a cross-sectional view of the head end siderail taken along line 3—3 of FIG. 2.
Figure 4:
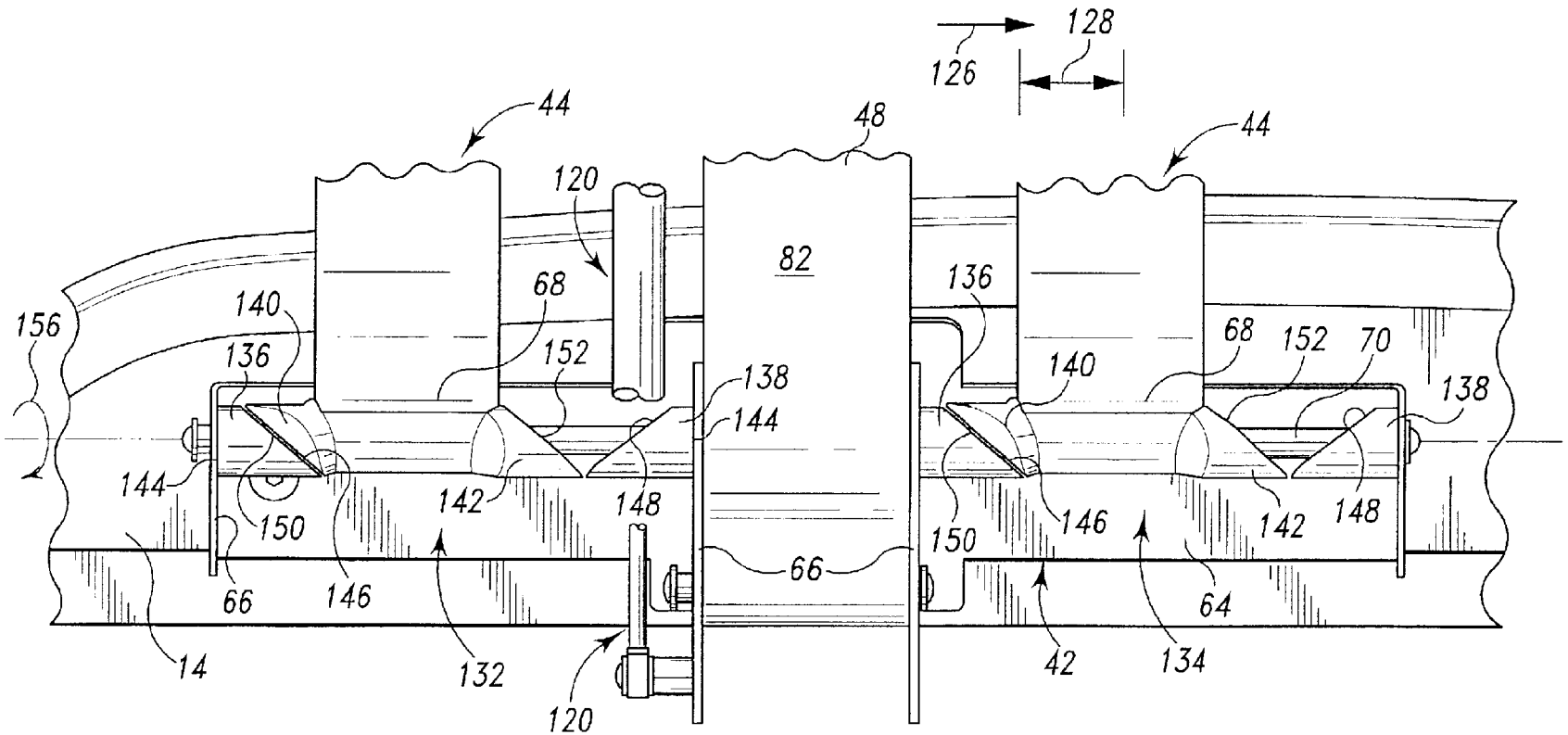
FIG. 4 is side elevation view of a portion of the head end siderail in the raised position showing the siderail including a pair of spaced-apart links pivotably coupled to a longitudinally extended rod, the rod including two pairs of cylindrical cam members, and each link including a pair of spaced-apart cylindrical cam members positioned to contact the cylindrical cam members of the rod.

First link 42 includes a base 64 coupled to intermediate weigh frame 26 and four upwardly extending flanges 66 rigidly coupled to base 64 as shown in FIG. 4. Each second link 44 includes a first end 68 pivotably coupled to flanges 66 by a rod 70 and a looped second end 72 pivotably coupled to third link 46 by a rod 74 as shown in FIG. 3.

Third link 46 includes a base 76, a first pair of inwardly extending flanges 78 coupled to base 76, and a second pair of inwardly extending flanges 80 also coupled to base 76 as shown in FIG. 2. Rod 74 extends between flanges 78 and through second ends 72 of second link 44 to provide the pivotable connection therebetween.

As shown in FIG. 2, fourth link 48 includes a base 82 and a latch-receiving slot 84 formed in base 82. A first end 86 of base is slidably and pivotably coupled to second pair of flanges 80 of third link 46 by a rod 88. A second end 90 of base 82 is pivotably coupled to the lower ends of flanges 66 of first link 42 by a rod 92. Thus, linkage assembly 38 provides a four bar linkage permitting siderails 20, 21 to swing sideways between the raised and lowered positions.

Figure 6:
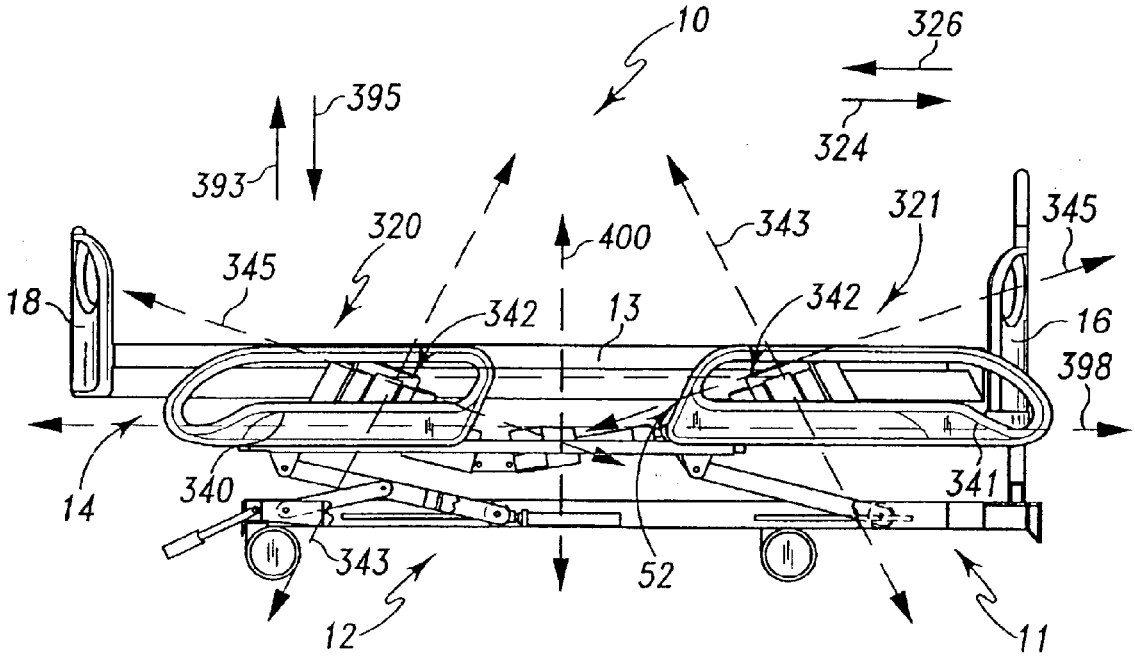
FIG. 6 is a side view of a second embodiment siderail in a raised blocking position.

Each siderail 20, 21 further includes a retainer 94 configured to "bind" the four bar linkage to prevent siderails 20, 21 from moving from the raised position to the lowered position. As shown in FIG. 3, retainer 94 includes a Z-shaped latch member 96 positioned in latch-receiving slot 84 and pivotably coupled to fourth link 48 by rod 98 to move between a latched position, as shown in FIG. 3, and an unlatched position and a catch rod 100 coupled to first link 42 by a pair of flanges 110. Rod 100 extends between flanges 110 as shown in FIG. 6. Latch member 96 includes a first end 112 that engages catch rod 100 and a second end 114. A handle 116 is provided that is coupled to second end 114. First end 112 includes a notch 118 configured to receive catch rod 100 therein to secure latch member 96 in the latched position as shown in FIG. 3.

When first end 112 is latched onto catch rod 100, a three bar linkage is established between first link 42, latch member 96, and fourth link 48. This arrangement of linkages binds first link 42 relative to fourth link 48 so that linkage assembly 38 is also bound from moving while latch member 96 is in the latched position to prevent siderails 20, 21 from swinging to the lower position.

To unbind linkage assembly 38 and permit siderails 20, 21 to swing to the down position, latch member 96 must be moved from the latched position to the unlatched position. A caregiver can unlatch latch member 96 by pulling downwardly and outwardly on handle 116 to pivot latch member 96 in the clockwise direction. This movement pulls first end 112 of latch member 96 away from catch rod 100 so that latch member 96 no longer binds first and fourth links 42, 48.

As shown in FIG. 4, assembly 38 further includes a gas spring or dashpot 120 coupled to first link 42 and third link 46. Gas spring 120 is compressed when siderail 20, 21 is lowered to dampen the movement and prevent rapid lowering of rail member 34.

Because first and fourth links 42, 48 are free to pivot relative to one another, linkage assembly 38 is also unbound and free to permit siderails 20, 21 to swing between the raised and lowered positions. A spring 122 is provided between a middle portion of fourth link 48 and a spring mount 124 coupled to a middle portion of latch member 96 to bias latch member 96 toward the latched position. According to alternative embodiments of the present disclosure, other retainers are provided to hold the siderails in the raised position such as clasps, catches, locks, other latches, clamps, pins, bolts, bars, hasp, hooks, or other retainers known to those of ordinary skill in the art.

Head end siderails 21 are configured to move longitudinally, in the directions of longitudinal axis 22, when raised and lowered. When lowered, head end siderail 21 moves in a first longitudinal direction 126, shown in FIG. 4, by a distance 128 toward a head end of head section 24 of deck 14. When raised, head end siderails 21 moves in a second longitudinal direction 130, shown in FIG. 6, by distance 128 back toward a foot end of head section 24.

The movement of siderails 20, 21 is also characterized by movement in sideways directions 129, 131 as shown in FIG. 3. The sideways movement in directions 129, 131 and the raising and lowering movements of siderails 20, 21 in directions 133, 135 cooperate to define directions 156, 158, respectively in which rail members 34, 36 travel during raising and lowering. Therefore, the movement of siderails 20, 21 between the raised and lowered positions have longitudinal components in directions 126, 130, as discussed above, along longitudinal axes 22 of rail members 34, 36, up and down or vertical components, and sideways or horizontal components in directions 129, 131.

According to an alternative embodiment of the present disclosure, clocking siderails are provided that have a cam assembly or sets of cam members configured to move the respective rail member laterally or sideways relative to the mattress during raising and lowering of the rail member. According to other alternative embodiments, cam members are provided to move the rail member in other directions during raising and/or lowering of the rail member.

By moving head end siderails 21 longitudinally when lowering, additional clearance is provided between head end siderail 21 and foot end siderail 20. Thus, when head section 24 of deck 14 is in the raised position (as shown in FIG. 2), foot end siderail 20 is in the raised position (as shown in FIG. 2), and head end siderail 21 is lowered from the raised position, rail member 34 of head end siderail 21 is pushed in direction 128 so that contact with foot end siderail 20 is avoided.

Figure 5:
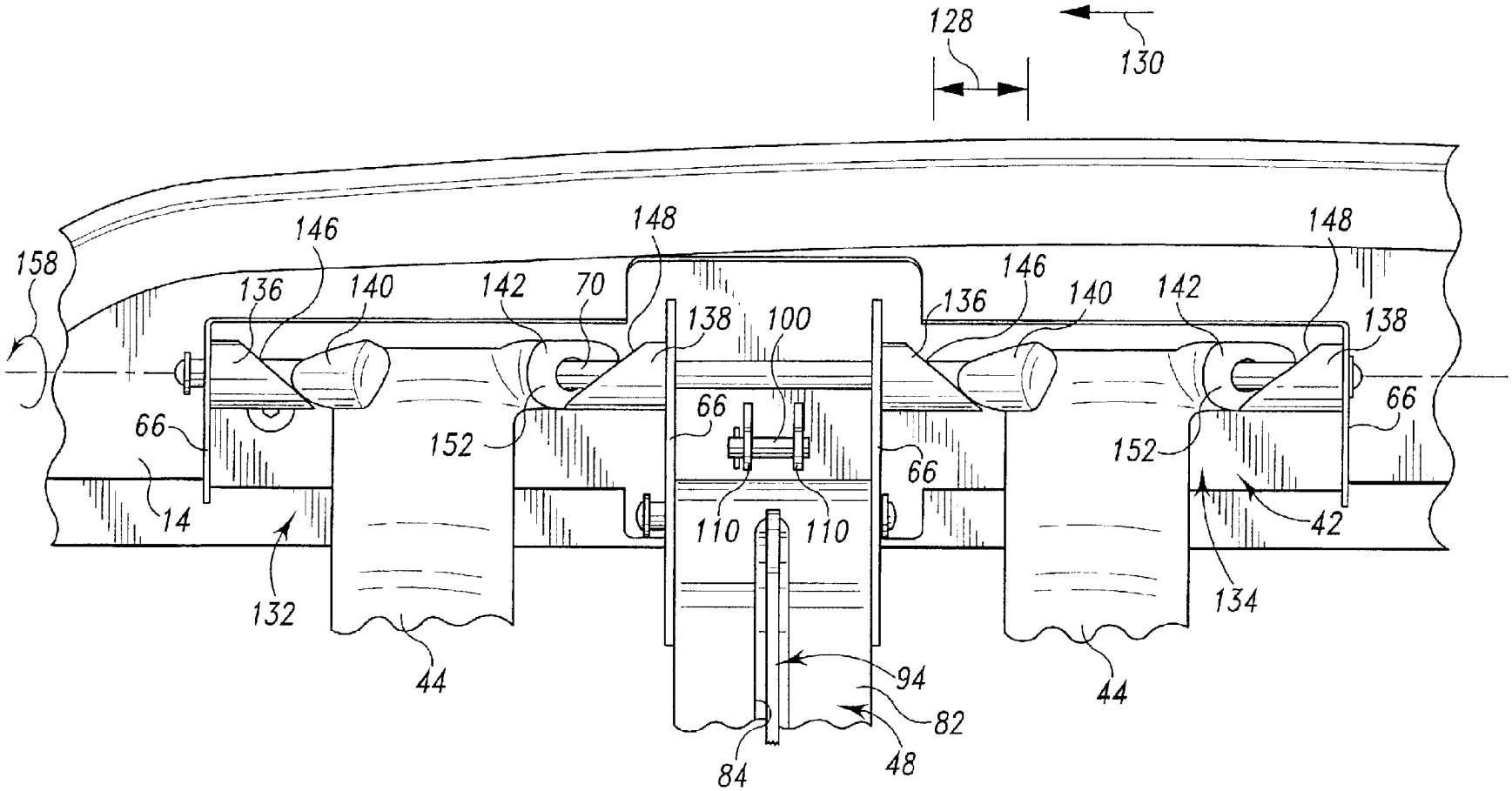
FIG. 5 is a view similar to FIG. 5 showing the siderail translated to the right when in the lowered position.

As shown in FIGS. 4 and 5, linkage assembly 38 of head end siderails 21 includes a first set of cam members 132 and a second set of cam members 134. Each set of cam members 132, 134 includes a pair of stationary cam members 136, 138 rigidly coupled to flanges 66 of first links 42 and a pair of rotary cam members 140, 142 rigidly coupled to first ends 68 of second links 44. As shown in FIGS. 4 and 5, rod 70 extends through rotary cam members 140, 142 to pivotably couple second links 44 to first links 42. According to an alternative embodiment of the present disclosure, only one set of cam members are provided.

As shown in FIG. 5, each stationary cam member 136, 138 is a truncated cylinder that has a first substantially flat end surface 144 coupled to flanges 66. Each respective stationary and rotary cam member 136, 138, 140, 142 further includes an inclined cam surface 146, 148, 150, 152 that cooperates with a longitudinal axis of rotation 154 of rod 70 to define respective angles therebetween of approximately 45°.

As shown in FIG. 5, cam surfaces 146 of stationary cam members 136 are substantially parallel with and slightly spaced-apart from cam surfaces 150 of rotary cam members 140 when head end siderail 21 is in the fully raised position. Cam surfaces 148 of stationary cam members 138 are spaced-apart from cam surfaces 152 of rotary cam members 142 and define an angle of approximately 90° therebetween.

When handle 116 is pulled, head end siderail 21 moves towards the lowered position. During this movement, rail member 34, second links 44, and rotary cam members 140 rotate in a clockwise direction 156, as shown in FIG. 5, so that cam surfaces 150 of rotary cam members 140 move into contact with cam surfaces 146 of stationary cam members 136. As shown in FIG. 6, continued rotation of rotary cam members 140 create forces between rotary cam members 140 and stationary cam members 136. These forces push rotary cam members 140, second links 44, and rail member 34 of head end siderail 21 in direction 126. When head end siderail 21 is moved to the lowered position, rail member 34 is pushed toward the head end of head section 24 by distance 128, as shown in FIG. 5.

As previously mentioned, third link 46 is slidably coupled to fourth link 48 by rod 88. During movement of rail member 34 of head end siderail 21 in direction 126, fourth link 48 does not move longitudinally so that third link 46 and rail member 34 slides relative to fourth link 48.

When head end siderail 21 is initially moved toward the raised position, cam surfaces 148 of stationary cam members 138 are slightly spaced-apart from cam surfaces 152 of rotary cam members 142. Cam surfaces 146 of stationary cam members 136 are slightly spaced-apart from cam surfaces 150 of rotary cam members 140.

As head end siderail 21 is moved further toward the raised position, rail member 34, second links 44, and rotary cam members 140 rotate in a counterclockwise direction 158, as shown in FIG. 5, so that cam surfaces 148 of stationary cam members 138 move into contact with cam surfaces 152 of rotary cam members 142. Continued rotation of rotary cam members 140 creates forces between rotary cam members 142 and stationary cam members 138. These forces push rotary cam members 142, second links 44, and rail member 34 of head end siderail 21 in direction 130. During this movement, third link 46 and rail member 34 slides relative to fourth link 48 in direction 130.

As shown in FIG. 4, cam surfaces 146 of stationary cam members 136 are substantially parallel with and slightly spaced-apart from cam surfaces 150 of rotary cam members 140 when head end siderail 21 is back to the fully raised position. Cam surfaces 148 of stationary cam members 138 are spaced-apart from contact cam surfaces 152 of rotary cam members 142 and define an angle of approximately 90° therebetween.

According to alternative embodiments of the present disclosure, other configurations of siderails that move in a longitudinal direction during raising and lowering are provided. These alternative embodiments includes other configurations of cam members, links, belts, cable, pulleys, or other mechanisms known to those of ordinary skill in the art for creating movement of a member in one direction based on movement of the same or another member in another direction.

Figure 7:
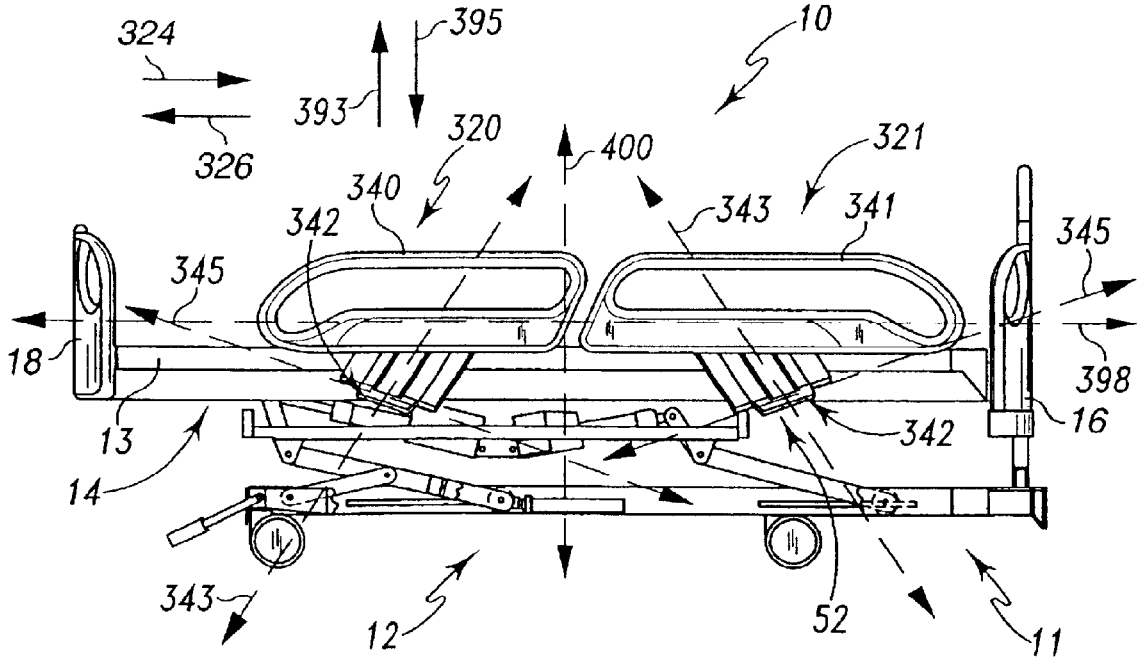
FIG. 7 is a view similar to FIG. 8 of the siderail in a lowered egress position.
Figure 8:
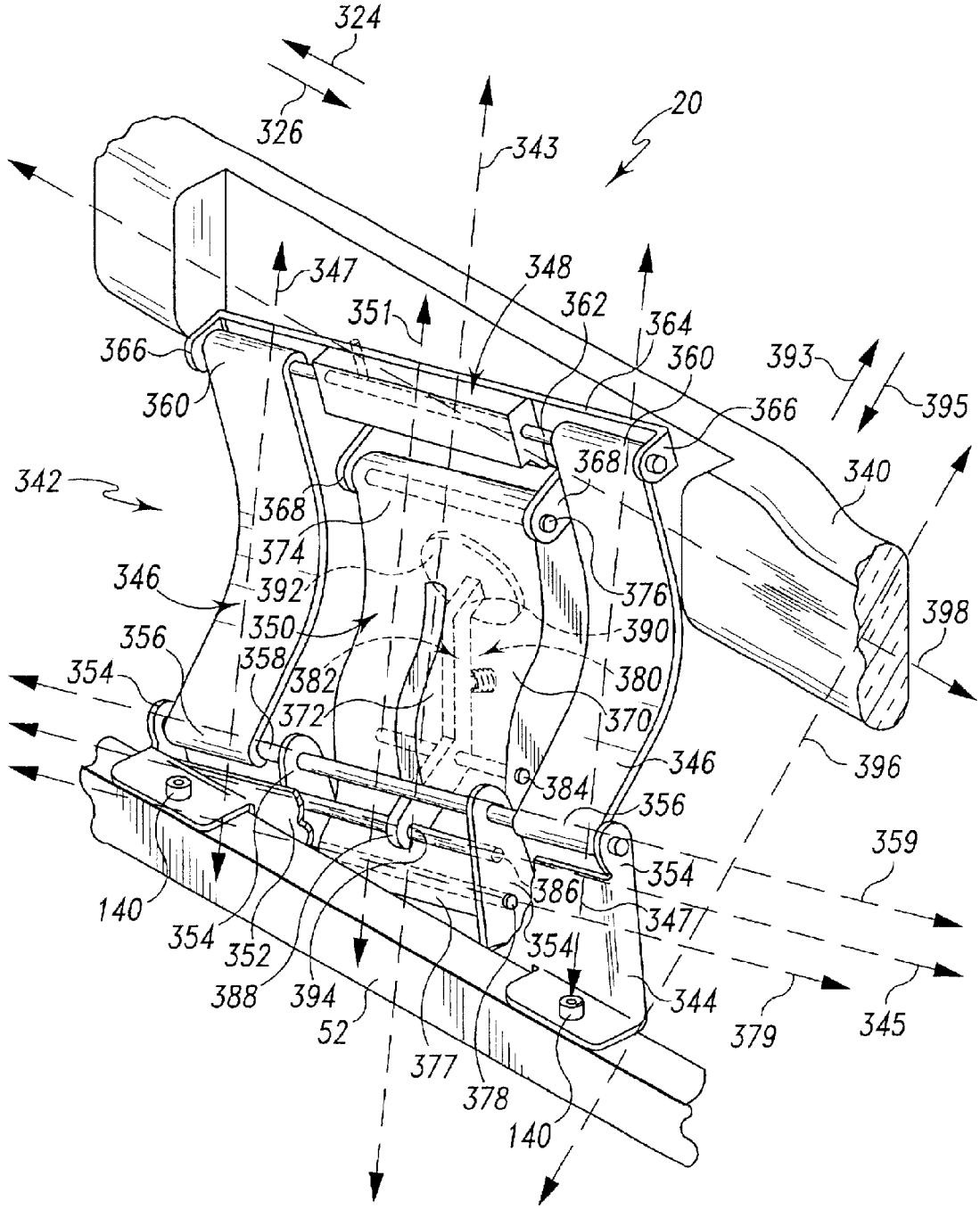
FIG. 8 is a perspective view of the second embodiment siderail showing the siderail including a linkage assembly coupled to the frame and a rail member, with portions broken away, coupled to the linkage assembly.

For example, as shown in FIGS. 6–8, another embodiment of the disclosure provides a hospital bed 310 including sub-frame 12 positioned on the floor, deck 14 coupled to sub-frame 12, a mattress 13 positioned on deck 14, headboard 16 coupled to sub-frame 12, footboard 18 coupled to deck 14, and a pair of split siderails 320, 321 coupled to frame 11. Sub-frame 12 is configured to raise and lower deck 14 relative to the floor and to move deck 14 to the Trendelenburg position and the Reverse Trendelenburg position.

Split siderails 320, 321 include respective rail members 340, 341 and couplers or linkage assemblies 342 coupled between respective rail members 340, 341 and intermediate frame 52 that permit rail members 340, 341 to be moved between raised and lowered positions as shown in FIGS. 7 and 6. As shown in FIG. 8, linkage assemblies 342 each include a first link 344 rigidly coupled to intermediate frame 52, a pair of curved second links 346 pivotably coupled to first link 344, a third link 348 pivotably coupled to second links 346, and a curved fourth link 350 pivotably coupled to third and first links 344, 348. Each of second 346 and fourth 350 links has a longitudinal axis 347, 351 that cooperate to define a general longitudinal axis 343 of linkage assembly 342. Rail members 340, 341 are coupled to third link 348.

Linkage assemblies 342 are fixed to intermediate frame 52 such that the longitudinal axes of second 346 and fourth 350 links are not perpendicular to a plane defined by intermediate frame 52 that is parallel to a plane defined by the patient support surface of mattress 13. In the raised position, longitudinal axis 343 of linkage assembly 342 has a vertical component parallel to vertical axis 400 and a longitudinal and horizontal component parallel to longitudinal axis 398 of rail member 340. Therefore, longitudinal axis 343 of linkage assembly 342 is not parallel with or perpendicular to longitudinal axis 398 of rail member 340.

First link 344 includes a base 352 coupled to intermediate frame 52 by fasteners 140 and four angled upwardly extending flanges 354 rigidly coupled to base 352. Each second link 346 includes a looped first end 356 pivotably coupled to flanges 354 by a rod 358 and a looped second end 360 pivotably coupled to third link 348 by a rod 362 as shown in FIG. 8. Rods 358, 362 are perpendicular to angled flanges 354 and not parallel to the plane of the intermediate frame 52. Further, second links 346 are perpendicular to rods 358, 362 such that first link 344 is not aligned directly above or below third link 348 when rail 320, 321 is in the raised or lowered position. Rather, third link 348 is longitudinally displaced toward or away from headboard 16 or footboard 18 relative to first link 344.

Third link 348 includes a base plate 364, a first pair of angled inwardly extending flanges 366 coupled to base plate 364, and a second pair of angled inwardly extending flanges 368 also coupled to base plate 364 as shown in FIG. 8. Rod 362 extends between flanges 366 and through second ends 360 of second link 346 to provide the pivotable connection therebetween.

As shown in FIG. 8, fourth link 350 includes a base 370 and a latch-receiving slot 372 formed in base 370. A first end 374 of the base 370 is pivotably coupled to second pair of flanges 368 of third link 348 by a rod 376. Similarly, a second end 377 of base 370 is pivotably coupled to the lower ends of flanges 354 of first link 344 by a rod 378. Thus, linkage assembly 342 provides a four bar linkage permitting siderails 320, 321 to swing sideways between raised and lowered positions.

As previously stated, linkage assemblies 342 are fixed to the intermediate frame 52 such that longitudinal axes 343 of linkage assemblies 342 are not perpendicular to a plane defined by intermediate frame 52. Therefore, as siderails 320, 321 swing between raised and lowered positions, siderails 320, 321 travel longitudinally in directions 324, 326. Second links 346 and fourth links 350 rotate about rods 358, 378. As shown in FIG. 8, rods 358 and 378 each have an axis of rotation 359, 379 that cooperate to define an overall axis of rotation 345 for linkage 342. The overall axis of rotation 345 has a vertical component in direction 393 parallel with vertical axis 400 and a longitudinal horizontal component in direction 324 parallel with longitudinal axis 398 of rail member 340. Therefore, axis of rotation 345 is not parallel with or perpendicular to longitudinal axis 398 of rail member 340 at any time when rail member 340 is stationary or during movement between the raised and lowered positions. Further, when mattress 13 is in a flat bed position, as shown in FIGS. 6 and 7, axis of rotation 345 is not horizontal.

Each siderail 320, 321 further includes a retainer 380 configured to bind the four bar linkage to prevent siderails 320, 321 from moving from the raised position to the lowered position. As shown in FIG. 8, retainer 380 includes a Z-shaped latch member 382 positioned in latch-receiving slot 372 and pivotably coupled to fourth link 350 by rod 384 to move between a latched position, as shown in FIG. 8 and an unlatched position. The retainer 380 also includes a catch rod 386 coupled to first link 344. Rod 386 extends between angled flanges 354 of first links 344. Rod 386 is parallel to rods 358, 378, 384 and not parallel with the plane of intermediate frame 52. Latch member 382 includes a first end 388 that engages catch rod 386 and a second end 390. A patient-inaccessible release or handle 392 is provided that is coupled to second end 390. First end 388 includes a notch 394 configured to receive catch rod 386 therein to secure latch member 382 in the latched position as shown in FIG. 8.

When first end 388 is latched onto catch rod 386, a three bar linkage is established between first link 344, latch member 382, and fourth link 350. This arrangement of linkages binds first link 344 relative to fourth link 350 so that linkage assembly 342 is also bound from moving while latch member 382 is in the latched position to prevent siderails 320, 321 from swinging to the lowered position.

As previously discussed, when siderails 320, 321 swing into the lowered position, the downward movement is accompanied by longitudinal movement as shown in FIGS. 6 and 7. The longitudinal movement associated with downward movement for head end siderail 321 is typically towards headboard 16 in direction 324 without any return movement in direction 326. Preferably, downward movement for head end siderail 321 is associated with longitudinal movement towards the headboard 16 in direction 324. The longitudinal movement associated with the downward movement of foot end siderail 320 is typically toward footboard 18 in direction 326. Preferably, similar to head end siderail 321, all downward movement the foot end siderail 320 is associated with longitudinal movement towards the footboard 18 in direction 326 without any return movement in direction 324. All upward movement of siderails 320, 321 is then associated with longitudinal movement in the direction 324, 326 opposite the longitudinal movement experienced during downward movement. Alternatively, upward and downward movement of siderails 320, 321 is characterized by longitudinal movement primarily in one direction 324, 326 but with some return movement in the opposite direction 326, 324. When both siderails 320, 321 are lowered, each is displaced away from a midpoint 400 between head board 16 and foot board 18. This displacement creates a space between the lowered siderails 320, 321 allowing access to the area beneath the mattress 13. This displacement also allows access to any foot controls or other devices that may be located on the frame like those disclosed in U.S. patent application Ser. No. 09/750,741, entitled Hospital Bed, to Osborne et al., the disclosure of which is expressly incorporated by reference herein.

According to other embodiments, it is not necessary that linkage assembly 342 be utilized on both head end and foot end siderails 321, 320. One of siderails 320, 321 employs linkage assembly 342 that longitudinally displaces rail member 340 and other siderail 320, 321 employs a linkage assembly that does not longitudinally displace rail member 141, 143.

According to other embodiments, linkage assembly 342 is configured to rotate 180° as it moves from the raised position to the lowered position. Longitudinal axis 343 defined by linkage assembly 342 in the raised position is collinear with longitudinal axis 343 defined by linkage assembly 342 in the lowered position.

In another embodiment, linkage assembly 342 is employed in bed 310 where siderails 320, 321 are attached to deck 14. By so attaching, siderails 320 321 articulate with the section 22, 24, 26, or 28 of deck 14 to which siderails 320, 321 are attached as respective section (22, 24, 26, 28) are tilted relative to intermediate frame 52. In embodiments that do not employ linkage assembly 342, head end rails 321 may sometimes hit foot end rails 320 when head end rails 321 are lowered from the raised position to the lowered position. By employing linkage assembly 342, head end rail 321 will move towards head board 16 as it is lowered, thereby allowing head end rail 321 to lower without contacting foot end rail 320.

According to alternative embodiments of the present disclosure, other configurations of couplers are provided to provide longitudinal or other movement during raising or lowering of the rail member. For example, according to one embodiment of the present disclosure, clocking linkages are provided that have an axes of rotation that have a longitudinal component in addition to a lateral component. Thus, when the rail member is clocked from the raised position to the lowered position, the rail member moves laterally away from or toward the mattress.

Although the invention has been described in detail with reference to preferred embodiments, variations and modifications exist within the scope and spirit of the invention as described and defined in the following claims.

What is claimed is:

1. A patient support comprising a frame, a mattress positioned over the frame, and a siderail including a rail member having a longitudinal axis and a linkage assembly configured to rotate about an axis of rotation to permit movement of the rail member between a raised position blocking egress of a patient positioned on the mattress and a lowered position permitting egress, the linkage assembly having a longitudinal axis deviating from being perpendicular to and deviating from being parallel with the longitudinal axis of the rail member at all times during movement of the rail member from the raised position to the lowered position.

2. The patient support of claim 1, wherein a longitudinal axis of the linkage assembly when the rail member is in the raised position is collinear with the longitudinal axis of the linkage assembly when the rail member is in the lowered position.

3. The patient support of claim 1, wherein the linkage assembly rotates about an axis of rotation that deviates from being perpendicular to and deviates from being parallel with the longitudinal axis of the rail member at all times during movement of the rail member from the raised position to the lowered position.

4. The patient support of claim 1, wherein the axis of rotation has a component that is vertical and a component that is horizontal when the mattress is in a flat bed position.

5. The patient support of claim 1, wherein the linkage assembly is configured to move the rail member in a first longitudinal direction during all downward movement of the rail member from the raised to lowered position.

6. The patient support of claim 5, wherein the linkage assembly is configured to move the rail member in a second longitudinal direction during all upward movement of the rail member from the lowered position to the raised position, the second longitudinal direction is opposite the first longitudinal direction.

7. A patient support comprising a frame, a mattress supported by the frame, and a siderail including a rail member and a coupler configured to couple the rail member to the frame, the rail member having a longitudinal axis, the coupler being configured to rotate the rail member about an axis of rotation from a raised position to a lowered position, the axis of rotation deviating from being perpendicular and deviates from being parallel with the longitudinal axis of the rail member at all times during rotation of the rail member from the raised position to the lowered position, the axis of rotation defining a plane that is parallel to the longitudinal axis of the rail member.

8. The patient support of claim 7, wherein the axis of rotation of the rail member deviates from being horizontal when the mattress is in a flat bed position.

9. The patient support of claim 7, wherein the axis of rotation of the rail member includes a horizontal component and a vertical component.

10. The patient support of claim 7, wherein the coupler is configured to move the rail member sideways away from the mattress and longitudinally during movement of the rail member to the lowered position.

11. A patient support comprising a frame, a mattress supported by the frame, and a siderail including a rail member and a coupler configured to couple the rail member to the frame, the rail member having a longitudinal axis, the coupler being configured to rotate the rail member about an axis of rotation from a raised position to a lowered position, the axis of rotation deviating from being perpendicular and deviates from being parallel with the longitudinal axis of the rail member at all times during rotation of the rail member from the raised position to the lowered position, the coupler including a linkage assembly having a longitudinal axis, the longitudinal axis of the linkage assembly when the rail member is in the raised position is collinear with the longitudinal axis of the linkage assembly when the rail member is in the lowered position.

12. A patient support comprising frame, a mattress supported by the frame, and a siderail including a rail member and a coupler configured to couple the rail member to the frame, the rail member having a longitudinal axis, the coupler being configured to rotate the rail member about an axis of rotation from a raised position to a lowered position, the axis of rotation deviating from being perpendicular and deviates from being parallel with the longitudinal axis of the rail member at all times during rotation of the rail member from the raised position to the lowered position, the coupler being configured to move the rail member in a first longitudinal direction during all downward movement of the rail member from the raised position to the lowered position.

13. The patient support of claim 12, wherein the coupler is configured to move the rail member in a second longitudinal direction during all upward movement of the rail member from the lowered position to the raised position, the second longitudinal direction being opposite the first longitudinal direction.

14. A patient support comprising a frame, a mattress supported by the frame, and a siderail including a rail member having a longitudinal axis and a coupler configured to couple the rail member to the frame and permit movement of the rail member between a raised position blocking egress of a patient positioned on the mattress and a lowered position permitting egress, the coupler being configured to move the rail member in a first longitudinal direction during all downward movement of the rail member from the raised position to the lowered position and movement of the rail member changes a distance between the rail member and the mattress.

15. The patient support of claim 14, wherein the coupler is configured to move the rail member in a second longitudinal direction during all upward movement of the rail member from the lowered position to the raised position, the second longitudinal direction is opposite the first longitudinal direction.

16. The patient support of claim 14, wherein the coupler includes a linkage assembly including a longitudinal axis, the longitudinal axis of the linkage assembly when the rail member is in the raised position is collinear with the longitudinal axis of the linkage assembly when the rail member is in the lowered position.

17. A patient support comprising a frame, a mattress supported by the frame, and a siderail including a rail member having a longitudinal axis and a coupler configured to couple the rail member to the frame and permit movement of the rail member between a raised position blocking egress of a patient positioned on the mattress and a lowered position permitting egress, the coupler being configured to move the rail member in a first longitudinal direction during all downward movement of the rail member from the raised position to the lowered position, the coupler configured to move the rail member sideways away from the mattress and longitudinally during movement of the rail member to the lowered position.

18. A patient support comprising a frame, a mattress supported by the frame, and a siderail including a rail member having a longitudinal axis and a coupler configured to couple the rail member to the frame and permit movement of the rail member between a raised position blocking egress of a patient positioned on the mattress and a lowered position permitting egress, the coupler being configured to move the rail member in a first longitudinal direction during all downward movement of the rail member from the raised position to the lowered position, the coupler rotating the rail member about an axis of rotation that deviates from being perpendicular and deviates from being parallel with the longitudinal axis of the rail member at all times during movement of the rail member from the raised position to the lowered position.

19. A patient support comprising a frame, a mattress supported by the frame, and a siderail including a rail member having a longitudinal axis and a coupler configured to couple the rail member to the frame and permit movement of the rail member between a raised position blocking egress of a patient positioned on the mattress and a lowered position permitting egress, the coupler being configured to move the rail member in a first longitudinal direction during all downward movement of the rail member from the raised position to the lowered position, the coupler rotating the rail member about an axis of rotation that deviates from being horizontal.

20. A patient support comprising a frame, a mattress supported by the frame, and a siderail including a rail member having a longitudinal axis and a coupler configured to couple the rail member to the frame and permit movement of the rail member between a raised position blocking egress of a patient positioned on the mattress and a lowered position permitting egress, the coupler being configured to move the rail member in a first longitudinal direction during all downward movement of the rail member from the raised position to the lowered position, the rail member rotating-about an axis of rotation that has a horizontal component and vertical component when the mattress in a flat bed position.

21. A patient support comprising a frame, a mattress positioned over the frame, and a siderail including a rail member having a longitudinal axis and a coupler configured to permit movement of the rail member between a raised position blocking egress of a patient positioned on the mattress and a lowered position permitting egress, the coupler being configured to move the rail member in a first longitudinal direction during lowering of the rail member to the lowered position without moving in a second longitudinal direction opposite the first longitudinal direction, the coupler being configured to move the rail member sideways away from the mattress during lowering of the rail member.

22. The patient support of claim 21, wherein the rail member rotates about an axis of rotation that deviates from being perpendicular and deviates from being parallel with the longitudinal axis of the rail member at all times during movement of the rail member from the raised position to the lowered position.

23. The patient support of claim 21, wherein the rail member rotates about an axis of rotation that deviates from being horizontal when the mattress is in a fiat bed position.

24. The patient support of claim 21 wherein the coupler is configured to move the rail member in the second longitudinal direction during raising of the rail member to the raised position without moving in the first longitudinal direction.

25. A patient support comprising a frame, a mattress positioned over the frame, and a siderail including a rail member having a longitudinal axis and a coupler configured to couple the rail member to the frame and to permit movement of the rail member between a raised position blocking egress of a patient positioned on the mattress and a lowered position, the coupler being configured to move the rail member in a longitudinal direction and a sideways direction away from the mattress during movement of the rail member between the raised and lowered positions, the lowered position placing the rail member outside a footprint of the frame.

26. The patient support of claim 25, wherein the rail member rotates about an axis of rotation during movement between the raised and lowered position and the axis of rotation has a longitudinal component.

27. The patient support of claim 26, wherein the axis of rotation has a horizontal component.

28. The patient support of claim 25, wherein the coupler includes a set of cam members that interact during movement of the rail member between the raised and lowered positions to move the rail member in the longitudinal direction.

29. The patient support of claim 25, wherein the linkage assembly rotates about an axis of rotation that deviates from being perpendicular to and deviates from being parallel with the longitudinal axis of the rail member at all times during movement of the rail member from the raised position to the lowered position.

30. The patient support of claim 25, wherein the linkage assembly rotates about an axis of rotation that deviates from being horizontal when the mattress is in a flat bed position.

31. The patient support of claim 30, wherein the axis of rotation has a component that is vertical and a component that is horizontal when the mattress is in a flat bed position.

32. A patient support comprising a frame, a mattress positioned over the frame, and a siderail including a rail member having a longitudinal axis and a coupler configured to couple the rail member to the frame and to permit movement of the rail member between a raised position blocking egress of a patient positioned on the mattress and a lowered position, the coupler being configured to move the rail member in a longitudinal direction and a sideways direction away from the mattress during movement of the rail member between the raised and lowered positions, the coupler being configured to move the rail member in a first longitudinal direction during all downward movement of the rail member from the raised to lowered position.

33. A patient support comprising a frame, a mattress positioned over the frame, and a siderail including a rail member having a longitudinal axis and a coupler configured to couple the rail member to the frame and to permit movement of the rail member between a raised position blocking egress of a patient positioned on the mattress and a lowered position, the coupler being configured to move the rail member in a longitudinal direction and a sideways direction away from the mattress during movement of the rail member between the raised and lowered positions, the coupler including a 4-bar linkage assembly.

34. A patient support comprising a frame, a mattress positioned over the frame, and a siderail including a rail member having a longitudinal axis and a coupler configured to couple the rail member to the frame and to permit movement of the rail member between a raised position blocking egress of a patient positioned on the mattress and a lowered position, the coupler being configured to move the rail member in a longitudinal direction and a sideways direction away from the mattress during movement of the rail member between the raised and lowered positions, a longitudinal axis of the linkage assembly when the rail member is in the raised position being collinear with the longitudinal axis of the linkage assembly when the rail member is in the lowered position.

35. A patient support comprising a frame, a mattress supported by the frame, and a siderail including a rail member and a coupler configured to permit rotation of the rail member about an axis of rotation between a raised position and a lowered position, the axis of rotation deviating from being horizontal when the mattress is in a flat bed position, and the axis of rotation defining a plane parallel to a plane defined by a side of the patient support.

36. The patient support of claim 35, wherein the rail member includes a longitudinal axis and the rail member moves in a longitudinal direction when moved between the raised and lowered positions.

37. The patient support of claim 36, wherein rail member moves sideways away from the mattress when moved between the raised and lowered positions.

38. The patient support of claim 35, wherein the rail member includes a longitudinal axis that deviates from being parallel with the axis of rotation.

39. A patient support comprising frame, a mattress supported by the frame, and a siderail including a rail member and a coupler configured to permit rotation of the rail member about an axis of rotation between a raised position and a lowered position, the axis of rotation deviating from being horizontal when the mattress is in a flat bed position, the rail member including a longitudinal axis that deviates from being parallel with the axis of rotation, the coupler including a 4-bar linkage assembly.

40. A patient support comprising a frame, a mattress supported by the frame, a siderail comprising a rail member having a first longitudinal axis and a linkage assembly configured to support the rail member on the frame, the linkage assembly having a second longitudinal axis and being configured to permit rotation of the rail member about an axis of rotation, the axis of rotation and the second longitudinal axis of the link assembly having a longitudinal component relative to the first longitudinal axis, and the axis of rotation failing to include a sideways component.

41. The patient support of claim 40, wherein the axis of rotation has a vertical and horizontal component when the mattress is in a flat bed position.

42. The patient support of claim 40, wherein the axis of rotation deviates from being horizontal when the mattress is in a flat bed position.

43. The patient support of claim 40, wherein the second longitudinal axis of the linkage assembly includes vertical and horizontal components when the mattress is in a flat bed position.

44. The patient support of claim 43, wherein the rail member moves sideways away from the mattress and longitudinally when moved to the lowered position.

* * * * *